US006078135A

United States Patent [19]

Lee et al.

[11] Patent Number: 6,078,135

[45] Date of Patent: Jun. 20, 2000

[54] METHOD FOR FORMING A SILICA FILM ON A FACE PANEL OF A CATHODE RAY TUBE

[75] Inventors: Jong-Hyuk Lee; Youn-Hyeong Cho, both of Seoul; Dong-Sik Chang, Kyonggi-do, all of Rep. of Korea

[73] Assignee: Samsung Display Devices Co., Ltd, Kyonggi-do, Rep. of Korea

[21] Appl. No.: 08/991,262

[22] Filed: Dec. 16, 1997

[30] Foreign Application Priority Data

Sep. 22, 1997 [KR] Rep. of Korea ..... 97-48098

[51] Int. Cl.[7] ..... H01J 31/00; B05D 5/06

[52] U.S. Cl. ..... 313/479; 313/478; 427/64

[58] Field of Search ..... 313/479, 478, 313/474, 473, 112, 113; 427/558, 64, 383.1, 162

[56] References Cited

U.S. PATENT DOCUMENTS 5,219,611 6/1993 Giannelis et al. ..... 427/162
5,243,255 9/1993 Iwaski et al. ..... 313/478
5,523,649 6/1996 Tong et al. ..... 313/479
5,652,477 7/1997 Tong et al. ..... 313/477
5,660,876 8/1997 Kojima et al. ..... 427/64
5,683,952 11/1997 Onozawa et al. ..... 502/242

*Primary Examiner*—Nimeshkumar D. Patel
*Assistant Examiner*—Joseph Williams
*Attorney, Agent, or Firm*—Baker & McKenzie

[57] ABSTRACT

A method for forming a silica film on a face panel is disclosed. The method includes steps of preparing a first composite having a staring material of a silica-titania two component system where alcohol is added as a catalyst; preparing a second composite having a titaniumalkoxide or a derivative of the titaniumalkoxide as a catalyst; mixing the first and second composites at a predetermined ratio; agitating the face panel; and calcinating the coated colloidal solution at a temperature of 160–200° C. The silica-titania two-component system is selected from a group consisting of a tetraethyl-silicate and a tetraethyl-silicate oligomer. The tetraethyl-silicate oligomer has a degree of polymerization of 40, 51 or 56.

8 Claims, No Drawings

METHOD FOR FORMING A SILICA FILM ON A FACE PANEL OF A CATHODE RAY TUBE

BACKGROUND OF THE INVENTION

1. Field of the Invention

The present invention relates to a method for forming a silica film on a panel and, more particularly, to a method for forming a silica film, which can interrupt electron waves or prevent static electricity, on a face panel for a cathode ray tube.

2. Description of Related Art

Generally, a face panel of a cathode ray tube manufactured through an assembly line goes through a coating process of a nonglare film, an antistatic film, an antireflection film, or/and an electron wave-proof film.

U.S. Pat. No. 5,660,876 to Kojima et al. discloses a method of manufacturing a cathode ray tube with a nonglare multi-layered film comprising at least a visible light absorbing layer containing a black dye, and an antistatic layer containing an inorganic metal compound used as a conductive agent. U.S. Pat. No. 5,523,649 to Tong et al. discloses a video display panel having multi-layered antireflective coating. The U.S. Pat. No. 5,652,477 discloses a display device having a multi-layered antistatic/antireflective coating.

The electron wave-proof film for interrupting the electron waves is usually made of a single-layered structure having a silica layer or a dual-layered structure having antistatic and silica layers.

The antistatic layer comprises a transparent conductive coating layer made of a material selected from the group consisting of an ITO and ATO or comprises a thin metal layer made of Ag, Ag/Pd. The silica layer is made through a sol-gel method.

As a well-known method for forming a silica film, water for a hydrolysis reaction is added to silicon alkoxide. Alcohol is used as common solvent of the silicon alkoxide and the water. In addition, acid is used as a catalyst to derive hydrolysis and polycondensation so as to form a thin film.

Describing more in detail, in the sol-gel method for forming a silica thin film, the silica film is made through a sol composition, coating, drying, and heating treatment processes. That is, composition of the silica sol is realized by adding a predetermined amount of water to a precursor such as, for example, a tetraethyl-o-silicate or a tetramethyl-o-silicate so as to derive hydrolysis reaction. At this point, since the silicon alkoxide is hydrophobic, a common solvent such as ethanol, methanol, or butanol is further added. After this, catalyst is further added to provide a sol particle structure that is suitable for being formed into thin film by a spin coating process or a dip-coating process and for accelerating hydrolysis reaction and polycondensation reaction. Generally, the catalyst is selected from the group consisting of organic or inorganic acids such as hydrochloric acid, nitric acid, acetic acid, and phosphoric acid, all of which have high acidity, and yet are dangerous agents that pose health risks.

In addition, as the thin film reacts to an acid-ionic group, if the thin film is a dual-layered structure, the thin film changes in physical property.

In the above description, the structure suitable for forming a thin film refers to the connecting structure of the silicate having a three-dimensional network structure or a linear structure having a siloxane bone, on one side of which a silanol group is coupled.

The kind of alkoxide, the amount of water, and the kind of alcohol have affect on the form of the resultant sol. However, when the amount of the water is determined, the form of the resultant sol is affected by the kind and amount of acid added as the catalyst.

Generally, in the binary system alkoxide reaction, a hetero condensation reaction between hydrolysises of each alkoxide occurs prior to the alkoxide reaction.

That is, the alkoxides M1 and M2 produce hydroxides through hydrolysis reactions as follows:

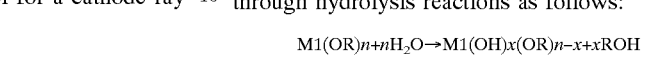

$$M1(OR)n+nH_2O \rightarrow M1(OH)x(OR)n-x+xROH$$

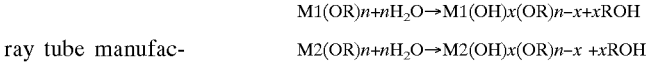

$$M2(OR)n+nH_2O \rightarrow M2(OH)x(OR)n-x+xROH$$

Each of the hydroxides produced as in the above converts oxygen bridge into a two-component condensation product of M1-O-M2 by water condensation between the hydroxides rather than by its homo condensation, thereby being accelerated in its reaction. This can be shown as follows:

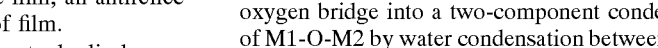

$$M1(OH)(OR)+M2(HO)(OR) \rightarrow (OR)M1\text{-}O\text{-}M2(OR)+H_2O$$

However, in case of the silica-titania two-component system, titanium alkoxide is used as a catalyst which can accelerate polycondensation reaction of the silicate. Chelate derivative can be also used as the catalyst that can adjust haydrolysis reaction speed of the titanium alkoxide.

Therefore, when the colloidal solution is coated on a face panel of a cathode ray tube, this becomes the silica film. That is, after the face panel is applied with the colloidal solution, it is calcinated at a temperature of about 300° C. so that the organization of the film is fined and the attachment thereof can be stabilized.

However, since the heat treatment process is locally performed in the cathode ray tube, differences in thermal expansion between the panel, explosion proof band, and a funnel occur. As a result, if severe, the cathode ray tube can crack or the coated film is disproportioned.

SUMMARY OF THE INVENTION

Therefore, there is a need for a method which can form the silica film on a panel of a cathode ray tube while eliminating the above described problems.

According to a feature of the present invention, to obtain a silica sol, a titanium alkoxide derivative is used to suppress deposition of a second phase of a titanium alkoxide which serves as a catalyst. Since this method does not use an acid as a catalyst, the problems of the conventional arts can be solved.

That is, the present invention provide a method for forming a silica film on a face panel of a cathode ray tube, comprising the steps of:

preparing a first composite, as a starting material, having a silica-titania two component system where alcohol is added as a solvent;

preparing a second composite having a titaniumalkoxide or a derivative of the titaniumalkoxide as a catalyst;

mixing the first and second composites at a predetermined ratio;

agitating the mixture to obtain a colloidal solution;

coating the colloidal solution on the face panel; and calcinating the coated colloidal solution at a temperature of 160–200° C.

According to a feature of the present invention, the silica-titania two-component system is selected from a group consisting of a tetraethyl-o-silicate and a tetraethyl-silicate oligomer.

According to another feature of the present invention, tetraethyl-silicate oligomer has a degree of polymerization of 40, 51 or 56.

According to still another feature of the present invention, the titaniumalkoxide derivate is a titanium acetyl acetone.

Preferably, the mixture ratio of the first and second composites is in a range from 1:1 to 10:1.

Preferably, the colloidal solution is coated on a nonglare film coated on the face panel.

DETAILED DESCRIPTION OF PREFERRED EMBODIMENTS

Detailed description of preferred embodiments of the present invention will be described hereinafter.

First Embodiment

After preparing a mixture composed of methanol of 18.9 W %, ethanol of 63.7 W %, and n-butanol of 9.4 W %, a first composite was made by dispersing tetraethyl-o-silicate of 6.7 W % into the mixture.

In addition, a second composite was made by adding acetyl acetone of 0.1 W % to titanium isopropoxide of 0.13 W %.

The first and second composites were mixed at a 1:1 ratio. After water of 1.2 W % was added into this mixture, a colloidal solution was obtained by agitating this mixture for about 10 hours.

After this, the colloidal solution of 50 cc was poured onto a 10×10 $cm^2$ glass while rotating the glass at 90 rpm. While increasing the rotating speed of the glass to 150 rpm, the colloidal solution was spin-coated on the glass. The gel film was dried and calcinated at a temperature of 180° C. for 30 minutes, thereby obtaining a silica film.

Second Embodiment

After preparing a mixture composed of methanol of 19.3 W %, ethanol of 65 W %, and n-butanol of 9.6 W %, a first composite was made by dispersing tetraethyl-o-silicate oligomer, having a degree of polymerization of 40, of 4.8 W % into the mixture.

In addition, a second composite was made by adding acetyl acetone of 0.09 W % to titanium isopropoxide of 0.13 W %.

The first and second composites were mixed at a 1:1 ratio. After water of 0.9 W % was added into this mixture, a colloidal solution was obtained by agitating this mixture for about 10 hours.

After this, the colloidal solution of 50 cc was poured into 10×10 $cm^2$ glass while rotating the glass at 90 rpm. While increasing the rotating speed of the glass to 150 rpm, the colloidal solution was spin coated on the glass. The gel film was dried and calcinated at a temperature of 160° C. for 30 minutes, thereby obtaining a desired silica film.

Third Embodiment

After preparing a mixture composed of methanol of 19.5 W %, ethanol of 65.9 W %, and n-butanol of 9.8 W %, a first composite was made by dispersing tetraethyl-o-silicate oligomer, having a degree of polymerization of 51, of 3.8 W % into the mixture.

In addition, a second composite was made by adding acetyl acetone of 0.09 W % to titanium isopropoxide 0.14 W %.

The first and second composites were mixed at a 1:1 ratio. After water of 0.8 W % was added into this mixture, a colloidal solution was obtained by agitating this mixture for about 10 hours.

After this, the colloidal solution of 50 cc was poured onto a 10×10 $cm^2$ glass while rotating the glass at 90 rpm. While increasing the rotating speed of the glass to 150 rpm, the colloidal solution was spin coated on the glass. The gel film was dried and calcinated at a temperature of 160° C. for 30 minutes, thereby obtaining a desired silica film.

Fourth Embodiment

After preparing a mixture composed of methanol of 19.6 W %, ethanol of 66 W %, and n-butanol of 9.8 W %, a first composite was made by dispersing tetraethyl-o-silicate oligomer, having a polymerization of 56, of 3.5 W % into the mixture.

In addition, a second composite was made by adding acetyl acetone of 0.1 W % to titanium isopropoxide of 0.14 W %.

The first and second composites were mixed at a 1:1 ratio. After water of 0.73 W % was added into this mixture, a colloidal solution was obtained by agitating this mixture for about 10 hours.

After this, the colloidal solution of 50 cc was poured onto a 10×10 $cm^2$ glass while rotating the glass at 90 rpm. While increasing the rotating speed of the glass to 150 rpm, the colloidal solution was spin coated on the glass. The gel film was dried and calcinated at a temperature of 200° C. for 30 minutes, thereby obtaining a desired silica film.

Fifth Embodiment

After preparing a mixture composed of methanol of 19.3 W %, ethanol of 65 W %, and n-butanol of 9.5 W %, a first composite was made by dispersing tetraethyl-o-silicate oligomer, having a degree of polymerization of 56, of 4.8 W % into the mixture.

In addition, a second composite was made by adding acetyl acetone of 0.09 W % to titanium isopropoxide of 0.13 W %.

The first and second composites were mixed at a 10:1 ratio. After water of 0.09 W % was added into this mixture, a colloidal solution was obtained by agitating this mixture for about 10 hours.

After this, the colloidal solution of 50 cc was poured onto a 10×10 $cm^2$ glass while rotating the glass at 90 rpm. While increasing the rotating speed of the glass to 150 rpm, the colloidal solution was spin coated on the glass. The gel film was dried and calcinated at a temperature of 180° C. for 30 minutes, thereby obtaining a desired silica film.

Resistance values of the silica films obtained through all of the above embodiments were tested. The silica films of the first through fifth embodiments were $10.10\times10^3\Omega/\square$, $9.85\times10^3$, $\Omega/\square$, $10.05\times10^3\Omega/\square$, $9.9\times10^3\Omega/\square$, $10.03\times10^3\Omega/\square$, respectively. These values are almost similar to a value of $10\times10^3\Omega/\square$ which was obtained through a method where an acid was used as the catalyst.

Therefore, in the present invention, as the titanium alkoxide derivate is used as the catalyst instead of acid, no health risks are posed to workers, In addition, as the temperature for calcination can be reduced, an anion base is not maintained and the interface reaction does not occur.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming a silica film on a face panel of a cathode ray tube, comprising the steps of:

preparing a first composite having a silica component and an alcohol is as a solvent;

preparing a second composite having a titaniumalkoxide or a derivative of the titaniumalkoxide as a catalyst;

mixing the first and the second composites at a predetermined ratio;

agitating the mixture to obtain a colloidal solution;

coating the colloidal solution on the face panel; and calcinating the coated colloidal solution at a temperature of 160–200° C.

2. The method of claim 1, wherein the silica component comprises a tetraethyl-o-silicate.

3. The method of claim 1 wherein the silica component comprises a tetraethyl-silicate oligomer.

4. The method of claim 3, wherein the tetraethyl-silicate oligomer has a degree of polymerization of 40, 51 or 56.

5. The method of claim 1, wherein the titaniumalkoxide derivate is a titanium acetyl acetone.

6. The method of claim 1, wherein the mixture ratio of the first and second composites is in a range from 1:1 to 10:1.

7. The method of claim 1, wherein the colloidal solution is coated on a nonglare film coated on the face panel.

8. A face panel of a cathode ray tube, comprising a silica film coated by methods defined by any one of claims 1–6.

* * * * *